United States Patent [19]

Brock

[11] 4,280,227

[45] Jul. 28, 1981

[54] CAPE PROTECTOR

[76] Inventor: Jean Brock, 411 Wilton St., Marianna, Fla. 32446

[21] Appl. No.: 96,934

[22] Filed: Nov. 23, 1979

[51] Int. Cl.[3] ..... A41D 3/08; A41B 13/10

[52] U.S. Cl. ..... 2/88; 2/50

[58] Field of Search ..... 2/48–52, 2/88

[56] References Cited

U.S. PATENT DOCUMENTS

| | | | |
|---|---|---|---|
| 1,445,312 | 2/1923 | Handlor | 2/88 |
| 1,598,838 | 9/1926 | Wilcott | 2/48 |
| 2,016,079 | 10/1935 | Deuel et al. | 2/50 |
| 2,501,010 | 3/1950 | Seidenbaum | 2/49 R |
| 2,744,252 | 5/1956 | Cansler | 2/50 |
| 2,879,514 | 3/1959 | Shapiro | 2/48 |
| 3,416,157 | 12/1968 | Marder | 2/49 |
| 3,629,865 | 12/1971 | Weiner | 2/48 |
| 4,025,961 | 5/1977 | Peters | 2/88 |

*Primary Examiner*—Doris L. Troutman

*Attorney, Agent, or Firm*—Hill, Van Santen, Steadman, Chiara & Simpson

[57] ABSTRACT

A protective cape is formed from a continuous piece of material, such as plastic, with a centrally located neck opening. The cape is formed with generally opposed portions relative to the neck opening, one of which has a relatively large area and the other of which has a relatively narrow area. The narrow area portion overlaps the large area portion along the front surfaces of the wearer's torso, so as to close the cape along the front surfaces of the wearer's neck. Fastening means are formed along engaging surfaces of the overlapped portions adjacent the neck opening. The fastening means comprise interlocking surfaces fitted to coincide with upper edges of the neck opening, such that the neck closure lies flat against the wearer's neck contour.

19 Claims, 3 Drawing Figures

CAPE PROTECTOR

BACKGROUND OF THE INVENTION

A. Field of the Invention

The invention relates to the art of protective outer garments and, especially, to capes worn by customers in the service of hair stylists.

B. The Prior Art

Typically, sleeveless outer garments or capes are worn by customers in the services of hair stylists to protect their clothing from shorn hair and hair-treating chemicals. These capes are in the form of one piece of protective material, such as plastic. A neck opening is centrally located in the cape material; and opposed ends of the neck opening are fastened together at the back or along the backsides of the neck in order to close the cape over the torso of the customer.

Fastening means, such as ties, hooks, or overlapping Velcro, raise the cape surfaces about the closure area away from the contour of the customer's neck. Because the cape closure is located along the back surfaces of the wearer's neck, the bulk of the fastening means may interfere with the hair stylist's instrument when treating hair there. For example, when a hair stylist combs out a women customer's long hair at the backside of her head, a comb may snag against the fastening means located there. Also, when a hair stylist trims hair at the back of the head, the raised surfaces of the cape adjacent the fastening means may be cut.

SUMMARY OF THE INVENTION

The present invention relates to a sleeveless cape garment formed of a continuous piece of material and with a centrally located neck opening. The cape is formed with generally opposed portions relative to the neck opening which overlap to close the cape about the wearer's torso along the front surfaces of the neck, preferably beneath the wearer's chin. One opposed portion may be formed with a relatively large area of material, and the other with a relatively narrow area of material. When worn, the large area portion of the cape extends across the front of the wearer's torso and over both shoulders. The narrow area portion of the cape extends over the backside of the wearer and its outer end drapes across the upper front of the wearer's torso overlying the other portion. Interlocking surfaces formed along the engaging surfaces of the overlapped portions are used to close the cape. The fastening surfaces extend all the way to the upper edges of the neck opening, such that the neck closure lies flat against the wearer's neck contour to enhance sealing. The neck opening may be collarless since the arrangement of fastening surfaces provides effective sealing without a collar.

DESCRIPTION OF THE PREFERRED EMBODIMENT

According to the preferred embodiment, the cape of the present invention is to be worn by customers in the service of a hair stylist to protect their clothes. The cape may be formed from protective material, such as plastic or nylon.

Figure 1:
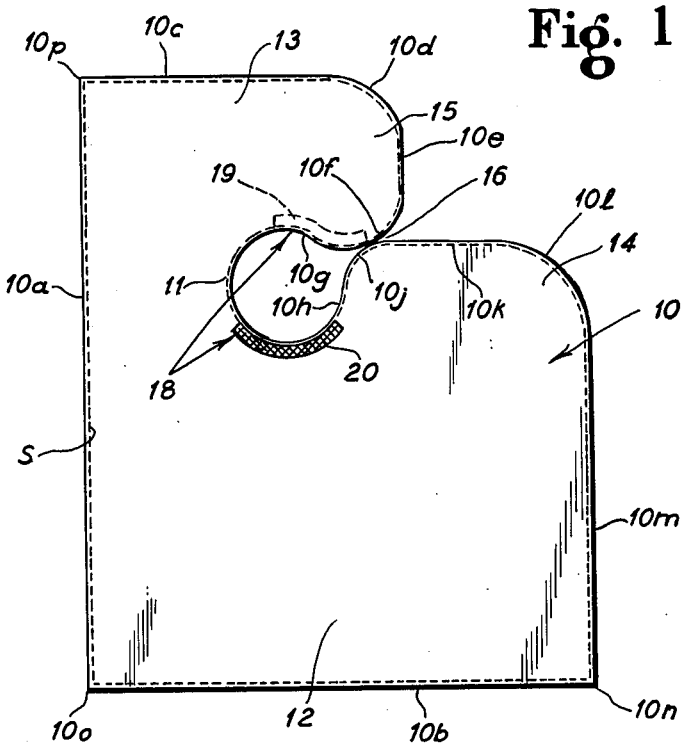
FIG. 1 is a top plan view of a cape of the present invention.

As shown in FIG. 1, the cape is sleeveless and formed of a continuous piece of material, which when laid flat has a generally centrally located neck opening 11. Relative to the neck opening, there is a first portion 12 and a generally opposed second portion 13 to the cape 10. The first portion 12 covers a relatively large area and the second portion 13 covers a relatively narrow area. Opposed outer ends 14 and 15, formed respectively on the first portion 12 and the second portion 13, define therebetween a front opening 16 through which the neck of a wearer may be passed in order for the cape to be worn.

More specifically, the protective cape garment shown generally at 10 is a generally rectangular sheet form body made of a flexible water-impervious material such as polyethylene or some other suitable plastic. The body member has a first edge **10*a* and a second edge 10*b***, both of which are full edges, i.e., they extend the full dimensional extent of the body at right angles to one another.

A third edge on the body member is shown at **10*c* and is spaced from and generally parallel to the edge 10*b*. The third edge 10*c* extends about one-half of the full edge dimension of the body member, whereupon the third edge 10*c* changes into an inwardly curving transition edge 10*b* which in turn, merges into a first straight edge portion 10*e* disposed to be in spaced parallel relation to the edge 10*a***.

The first straight edge portion **10*e* merges into a reversely curved interior edging section including a first curve 10*f* and a second curve 10*g*, the curve 10*g* forming part of an interior circular recess which constitutes the neck opening 11, and which circular recess or neck opening 11 is larger than the average neck dimensions of a human being. The opposite side of the circular recess is formed by a second reversely curved portion including a curve 10*h* which is disposed opposite the curve 10*g* and a curve 10*j* which merges into a second straight edge portion 10*k* disposed in parallel spaced relation to the edge 10*b***.

The second straight edge portion **10*k* terminates in an wardly curving transition edge 10*l*, which in turn merges with a forth edge 10*m* on the body portion. The fourth edge of the body member is spaced from and generally parallel to the edge 10*a* and intersects the edge 10*b* at a corner 10*n*. A corner 10*o* is disposed between the edges 10*a* and 10*b* and a corner 10*p* is disposed between the edges 10*a* and 10*c*. Edges 10*e* and 10*k* serving as side surfaces for a generally rectangular notched space cut away in the area of the remaining corner portion of the rectangular sheet 10**.

In order to reinforce and finish all of the edges of the garment, edging stitches shown by means of a phantom dashed line adjacent the edge are shown at S.

The cape 10 fits about the wearer's torso such that the large area portion fits across the front of the torso and drapes over both shoulders to cover the sides. For the cape 10 shown in FIG. 1, the outer end 14 would drape as a flap over the left shoulder of the wearer. The narrow portion 13 lies flat across the back of the torso; however, the outer end 15 of the narrow portion 13 extends exteriorally as a flap across the upper area of the front side of the torso. Outer end 15 overlies the large area portion 12 adjacent the neck of the wearer, closing the cape 10 about the wearer.

Interlocking surfaces 18 are formed on each of the cape portions 12 and 13 along edges of the neck opening 11 to fasten the cape along front surfaces of the wearer's neck. For purposes of loop pile fastener or the preferred embodiment, interlocking strips of Velcro are utilized for the fastening means 18; however, other types of fastening means, such as hooks or ties, are within the contemplation of the present invention. In order to close the cape 10, a first fastening surface 19 is secured along the interior or engaging surface of the overlapping portion 13 about the neck opening 11. A second fastening surface 20 is secured along the engaging surface or exterior of the underlying portion 12. As the outer end 15 is drawn across the underlying portion 12, the interiorally facing surface 19 coincides with the exteriorally facing surface 20. Outer end 15 is drawn about the front of the wearer's neck until the edges of the neck opening 11 form a tight seal with the wearers's neck surfaces. At this point, the surfaces 19 and 20 are fastened to each other and the cape becomes closed about the wearer's torso. The surfaces 19 and 20 are each preferably sized to be of such length as to accommodate all sizes of necks.

It will be apparent that in using the orientation of the article in terms of its edges, there are provided locking means which are located on the reversely curved interior edging and on the circular recess which locking means operate to lock the cape garment around the neck of a person to be protected. Such locking means are preferably constructed and arranged so that some adjustment may be afforded with respect to the size of the neck of the user. Thus, in the specific embodiment shown, the first Velcro strip 19 is of discrete length and is disposed on one side of the body member at the reversely curved edge 10*f* and 10*g*. The second Velcro strip is also of discrete length and is mounted on the opposite side of the body member at the bottom portion of the circular recess or neck opening 11. Thus, when the edges 10*f*, 10*g* are drawn around the neck of the user and the strip 19 is placed in engagement with the strip 20, the strips 19 and 20 will selectively engage one another in adjustable fastening relation to lock the cape in position.

The fastening surfaces 19 and 20 are fitted, by conventional means such as sewing, so as to coincide with upper edges of the neck opening 11. In this manner, when the surfaces 19 and 20 become attached, edges of the neck opening 11 will lie flat against the contours of the wearer's neck, providing an effective seal about the neck. Because an effective seal is so provided, the neck opening 11 may be collarless. A collarless neck opening is preferable when the cape is to be used by a barber in that there is no need to pull a collar down when shaving the neck.

Figure 2:
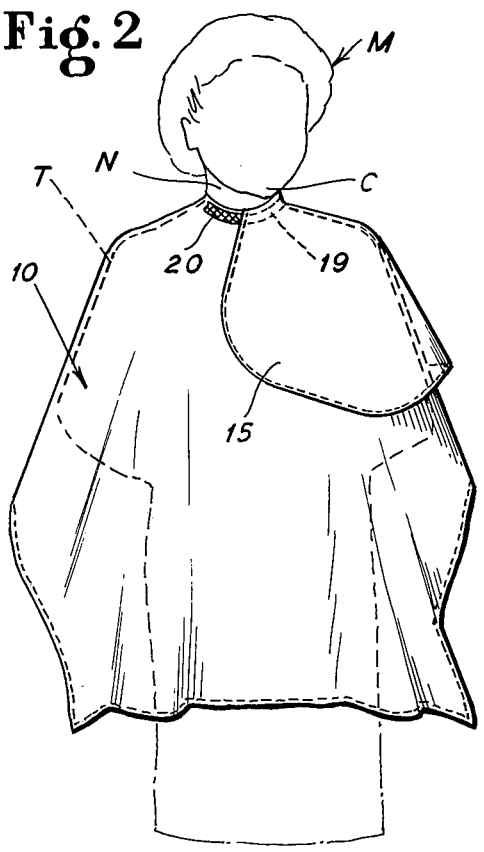
FIG. 2 is a general perspective front plan view of a cape of the present invention attached to a wearer.
Figure 3:
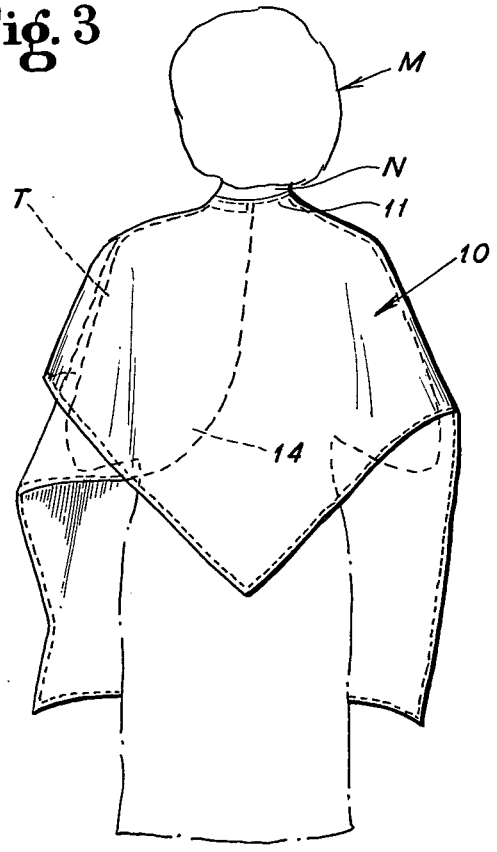
FIG. 3 is a general perspective back plan view of a cape of the present invention attached to a wearer.

FIG. 2 illustrates the cape when worn over the torso T of a model M. The front opening 16 and the fastening means 18 are arranged so that the overlapping cape closure occurs along the front side surfaces of the wearer's neck N and, preferably, beneath the wearer's chin C. As a result, the back edges of the neck opening 11 are continuous and lay flat against the contours of the wearer's neck N without any raised area. The hair stylist is able to treat hair along the back of the head of the patron M without encumbering instruments in the cap closure means.

Although various minor modifications may be suggested by those versed in the art, it should be understood that I wish to embody within the scope of the patent warranted hereon all such modifications as reasonably and properly come within the scope of my contribution to the art.

I claim as my invention:

1. A protective cape garment comprising a generally rectangular sheet-form body member made of flexible water-impervious plastic material, first and second full edges on said body member disposed at right angles to one another, a third edge on said body spaced from and generally parallel to one of said first and second edges, said third edge extending about one-half of the full edge dimension of said body member, whereupon said third edge changes into an inwardly curving transition edge which, in turn, merges into a first straight portion disposed to be in spaced parallel relation to the other of said first and second edges, said first straight edge portion merging into a first reversely curved interior edging section and forming a generally circular recess larger than the average neck dimension of a human being, said circular recess merging consecutively through a second reversely curved interior edging section and into a second straight edge portion disposed in parallel spaced relation to said one of said first and second edge portions, said second straight edge portion terminating in an outwardly curving transition edge which, in turn, merges with a fourth edge on said body portion, said fourth edge on said body portion spaced from and generally parallel to the other of said first and second edges, edging stitches on all of the edges of said body member to reinforce and finish the edges thereof, and locking means on said reversely curved interior edging and on said circular recess to lock the cape garment around the neck of a person to be protected.

2. A protective cape garment as defined in claim 1 and further characterized by said locking means comprising complementary loop pile fastener strips of discrete length and being disposed on opposite sides of said body member to selectively engage one another in adjustable fastening relation.

3. A cape garment for use in hair dressing to protect the clothing of the wearer and so constructed as to be draped about the wearer with the closure of the garment arranged in the front of the wearer, said garment comprising:

A. a generally rectangular configuration sheet form body member made of flexible, protective material, B. a circular neck recess in said body member located closer to one end edge of the configuration than to the other end edge, C. a generally rectangular notch in a corner of the body member adjacent to said neck recess and effective to shorten said one end edge and shorten the side edge adjacent to said notch, D. a passageway extending generally from the innermost corner of said notch to said neck recess and connected therewith whereby to produce two flaps adjacent the neck recess adapted to be cross draped about the torso of the wearer when the wearer's neck is engaged in said recess and the recess is closed around and against the wearer's neck and E. separable locking means of a non-protruding type at the neck recess to enable the cape garment removably to be locked in said draped condition.

4. The cape garment as claimed in claim 3 in which edging stitches are provided on substantially all of the edges of said body member to reinforce and finish said edges.

5. The cape garment as claimed in claim 3 in which the junctures of the notch and the adjacent end edge and side edge are rounded and in additiop the portions of the body member at least at the outermost ends of said passageway are also rounded whereby when in draped condition of the garment the flaps will generally be rounded.

6. The cape garment as claimed in claim 3 in which the material of said body member is liquid impervious.

7. The cape member as claimed in claim 3 in which said separable locking means comprise loop pile fastening strip means located at cooperating locations about the neck recess to enable same to adhere together closing the neck recess when the garment is so draped.

8. The cape member as claimed in claim 7 in which a portion of said loop pile fastening strip means extends into said passageway on one of said flaps adapted to overlie the other flap when said garment is so draped and thereby enable being attached to said neck recess.

9. A sleeveless cape garment for use by persons in the services of hair stylists which closes about the neck and substantially drapes about the wearer comprising a generally rectangular flat sheet made of flexible, protective material and having:

three substantially identical rectangular corner portions, two at one end of said sheet and one at the other end of said sheet, the remaining rectangle corner portion being cut away and having first and second free edges together with one another defining a generally rectangular notched space, said sheet having formed therein a neck recess in the form of a generally continuous circle disposed inwardly of said remaining rectangle corner portion and extending between first and second free edges, an opening formed between said free edges connecting said neck recess with said notched space for passage of the wearer's neck therethrough, first and second flap portions, including said first and second edges, respectively, and extending from corresponding sides of said notched space, for overlapping beneath the wearer's chin to close said neck recess about the wearer's neck, and locking means on said sheet at said neck recess to hold said flap portions in the overlapped position.

10. The sleeveless cape garment according to claim 9, wherein said opening extends from the innermost corner of said notched space to said neck recess.

11. The sleeveless cape garment according to claim 9, wherein said neck recess is collarless and said locking means comprises separable fastening means extending about and connected to the edges of said neck recess for enabling said neck recess to lie flat about the wearer's neck when closed.

12. The sleeveless cape garment according to claim 11, wherein said fastening means comprise complementary loop pile fastener strips disposed on opposite sides of said sheet for overlying one another when said flap portions close about the wearer's neck.

13. The sleeveless cape garment according to claim 9, wherein said sheet is made of plastic sheet form water impervious material.

14. The sleeveless cape garment according to claim 9, further comprising edging stitches extending continuously along all the edges of said sheet.

15. The sleeveless cape garment according to claim 9, wherein said neck recess is disposed closer to said other end of said sheet than to said one end.

16. A cape garment for closing about the neck and draping over a wearer comprising a generally rectangular flat sheet made of protective flexible material and being provided with:

a collarless neck recess within the sheet edges, a cut-away open space through one rectangle corner portion of said sheet defined by first and second edges substantially at joining one another, an opening extending between said cut-away space and said neck recess for passage of the wearer's neck into said neck recess, first and second flap portions separated from one another by said opening and said cut-away space for overlapping beneath the wearer's chin to close said neck recess about the wearer's neck, and separable fastening means comprising complementary connective means positioned generally concentrically adjacent said neck recess in discrete lengths and on opposite sides of said sheet to lock said flap portions in overlying relation and enable said neck recess to lie flat against and closely engage with the wearer's neck.

17. The cape garment according to claim 16, wherein said fastening means comprises a pair of loop pile fastener strips.

18. The cape garment according to claim 16, wherein said cut-away space comprises a generally rectangular notch in place of said one rectangle corner of said sheet.

19. The cape garment according to claim 16, wherein one fastening means length extends adjacent and into said opening.

* * * * *

UNITED STATES PATENT AND TRADEMARK OFFICE

CERTIFICATE OF CORRECTION

PATENT NO. : 4,280,227

DATED : July 28, 1981

INVENTOR(S) : Jean Brock

It is certified that error appears in the above—identified patent and that said Letters Patent is hereby corrected as shown below:

Column 3, line 65, change "area" to --areas--;

Column 5, line 13, correct the misspelling of --addition--;

Column 5, line 35, change "rectangular" to --rectangle--;

Column 6, line 32, before "edges" insert the word --free--.

Signed and Sealed this

*Twenty-fifth* Day of *May 1982*

[SEAL]

*Attest:*

GERALD J. MOSSINGHOFF

*Attesting Officer*

*Commissioner of Patents and Trademarks*